US008929799B2

(12) United States Patent
Naoi

(10) Patent No.: US 8,929,799 B2
(45) Date of Patent: Jan. 6, 2015

(54) IMAGE FORMING APPARATUS

(71) Applicant: Konica Minolta, Inc., Tokyo (JP)

(72) Inventor: Shinya Naoi, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 151 days.

(21) Appl. No.: 13/785,949

(22) Filed: Mar. 5, 2013

(65) Prior Publication Data

US 2013/0243448 A1 Sep. 19, 2013

(30) Foreign Application Priority Data

Mar. 19, 2012 (JP) ..... 2012-061542

(51) Int. Cl.

| | |
|---|---|
| ***G03G 15/00*** | (2006.01) |
| ***B65H 1/04*** | (2006.01) |
| ***B65H 1/08*** | (2006.01) |
| ***B65H 1/14*** | (2006.01) |
| ***B65H 7/14*** | (2006.01) |
| *B65H 3/06* | (2006.01) |

(52) U.S. Cl.

CPC ..... *G03G 15/6502* (2013.01); *B65H 1/14* (2013.01); *B65H 7/14* (2013.01); *B65H 3/0607* (2013.01); *B65H 2511/22* (2013.01); *B65H 2511/30* (2013.01); *B65H 2511/33* (2013.01)

USPC ..... 399/393; 271/145

(58) Field of Classification Search

CPC ..... G03G 15/00; G03G 21/00; B65H 1/00; B65H 1/04; B65H 1/08; B65H 11/00

USPC ..... 399/393; 271/154–164

See application file for complete search history.

(56) References Cited

U.S. PATENT DOCUMENTS

| | | | | |
|---|---|---|---|---|
| 5,649,274 | A * | 7/1997 | Honda et al. | 399/375 |
| 6,067,806 | A * | 5/2000 | Park | 62/137 |
| 6,254,085 | B1 * | 7/2001 | Kang | 271/171 |

(Continued)

FOREIGN PATENT DOCUMENTS

| | | |
|---|---|---|
| JP | 2-147544 | 6/1990 |
| JP | 3-56743 | 5/1991 |

(Continued)

OTHER PUBLICATIONS

Japanese Office Action, Notification of Reason for Refusal, Patent Application No. 2012-061542. Dispatch Date: Feb. 12, 2014 (2 pages).

(Continued)

*Primary Examiner* — Nguyen Ha

(74) *Attorney, Agent, or Firm* — Lucas & Mercanti, LLP

(57) ABSTRACT

An image forming apparatus having: a slit plate in which a plurality of slits of different widths are provided, the slit plate being movable in an amount proportional to an amount of movement of a elevating plate; a sensor unit disposed such that the slits pass between a luminous element and a light-sensitive element, the sensor unit outputting a detection signal that indicates whether light emitted by the luminous element is in a transmitted state or not; and a control unit that stores positions of the elevating plate corresponding to the widths of the slits, and identifies a position of the elevating plate corresponding to a slit width derived from a detection signal outputted by the sensor unit, thereby deriving a remaining quantity of sheets on the elevating plate.

11 Claims, 11 Drawing Sheets

(56) References Cited

U.S. PATENT DOCUMENTS

| | | | | |
|---|---|---|---|---|
| 2003/0057364 | A1* | 3/2003 | Hashimoto | 250/231.13 |
| 2007/0229005 | A1* | 10/2007 | Ishizaki | 318/254 |
| 2007/0272840 | A1* | 11/2007 | Musha et al. | 250/231.13 |
| 2011/0031679 | A1* | 2/2011 | Fujita | 271/90 |

FOREIGN PATENT DOCUMENTS

| | | | | | |
|---|---|---|---|---|---|
| JP | 05116785 | A | * | 5/1993 | G03G 15/00 |
| JP | 05229674 | A | * | 9/1993 | G03G 15/00 |
| JP | 2003075200 | A | * | 3/2003 | G01D 5/36 |
| JP | 2003165650 | | | 6/2003 | |
| JP | 2010-151476 | | | 7/2010 | |

OTHER PUBLICATIONS

English translation of Japanese Office Action, Notification of Reason for Refusal, Patent Application No. 2012-061542. Dispatch Date: Feb. 12, 2014 (3 pages).

* cited by examiner

IMAGE FORMING APPARATUS

This application is based on Japanese Patent Application No. 2012-061542 filed on Mar. 19, 2012, the content of which is incorporated herein by reference.

BACKGROUND OF THE INVENTION

1. Field of the Invention

The present invention relates to an image forming apparatus with a supply device that feeds a recording medium placed on an elevatable tray toward a transfer area where a toner image is transferred onto the recording medium.

2. Description of Related Art

A conventional image forming apparatus with a supply device as described above is described in, for example, Japanese Patent Laid-Open Publication No. 2003-165650. This supply device has a light shield attached to a lift plate (elevating plate) that supplies a recording medium (e.g., paper) to a feed position by vertically changing the position of the recording medium. Three detection sensors for performing detection on the basis of whether irradiation light is blocked or not are vertically arranged in positions where the light shield can block irradiation light by the position of the lift plate being changed. The remaining quantity of sheets of recording medium that corresponds to the position of the lift plate is detected on the basis of a combination of the results of detection by the detection sensors.

However, to accurately detect the remaining quantity of sheets of recording medium, the supply device requires a number of detection sensors to be vertically arranged at short intervals.

SUMMARY OF THE INVENTION

An image forming apparatus according to an embodiment of the present invention includes: an elevating plate provided in a cassette so as to be able to ascend in a range from a bottom position to a top position with sheets of recording medium placed thereon; a roller group at least including a pickup roller to take up and feed the top of the sheets of recording medium placed on the elevating plate during a printing process; a print unit that forms an image on the recording medium fed by the roller group during the printing process; a drive mechanism at least including a motor whose rotational speed is kept constant regardless of torque, the drive mechanism raising the elevating plate by means of a drive force from the motor until the top of the sheets of recording medium placed on the elevating plate contacts the pickup roller; a slit plate having a plurality of slits of different widths provided therein, the slit plate being movable in an amount proportional to an amount of movement of the elevating plate while the elevating plate ascends from the bottom position to the top position; a sensor unit disposed such that the slits pass between a luminous element and a light-sensitive element, the sensor unit outputting a detection signal that indicates whether light emitted by the luminous element is in a transmitted state or in a blocked state; and a control unit having memorized therein positions of the elevating plate that correspond to the widths of the slits, the control unit identifying a position of the elevating plate that corresponds to a slit width derived from a detection signal outputted by the sensor unit when the motor is driven at a constant rotational speed, thereby deriving a remaining quantity of sheets on the elevating plate.

An image forming apparatus according to another embodiment of the present invention includes: an elevating plate provided in a cassette so as to be able to ascend in a range from a bottom position to a top position with sheets of recording medium placed thereon; a roller group at least including a pickup roller to take up and feed the top of the sheets of recording medium placed on the elevating plate during a printing process; a processing unit that forms a toner image during the printing process by developing an electrostatic latent image formed on a charged image support; a transfer unit that transfers the toner image formed on the image support to the recording medium fed by the roller group during the printing process; a drive mechanism at least including a motor, the drive mechanism raising the elevating plate by means of a drive force from the motor until the top of the sheets of recording medium placed on the elevating plate contacts the pickup roller; a slit plate having a plurality of slits provided therein, the slit plate being movable in an amount proportional to an amount of movement of the elevating plate while the elevating plate ascends from the bottom position to the top position, wherein the slit plate is adapted such that any two neighboring slits from among all of the slits have different width ratios; a sensor unit disposed such that the slits pass between a luminous element and a light-sensitive element, the sensor unit outputting a detection signal that indicates whether light emitted by the luminous element is in a transmitted state or in a blocked state; and a control unit having memorized therein positions of the elevating plate that correspond to ratios of neighboring-slit widths, the control unit identifying a position of the elevating plate that corresponds to a ratio of neighboring-slit widths obtained on the basis of widths of neighboring slits derived from a detection signal outputted by the sensor unit when the motor is driven at a constant rotational speed, thereby deriving a remaining quantity of sheets on the elevating plate.

DETAILED DESCRIPTION OF THE PREFERRED EMBODIMENTS

First Embodiment

Figure 1:
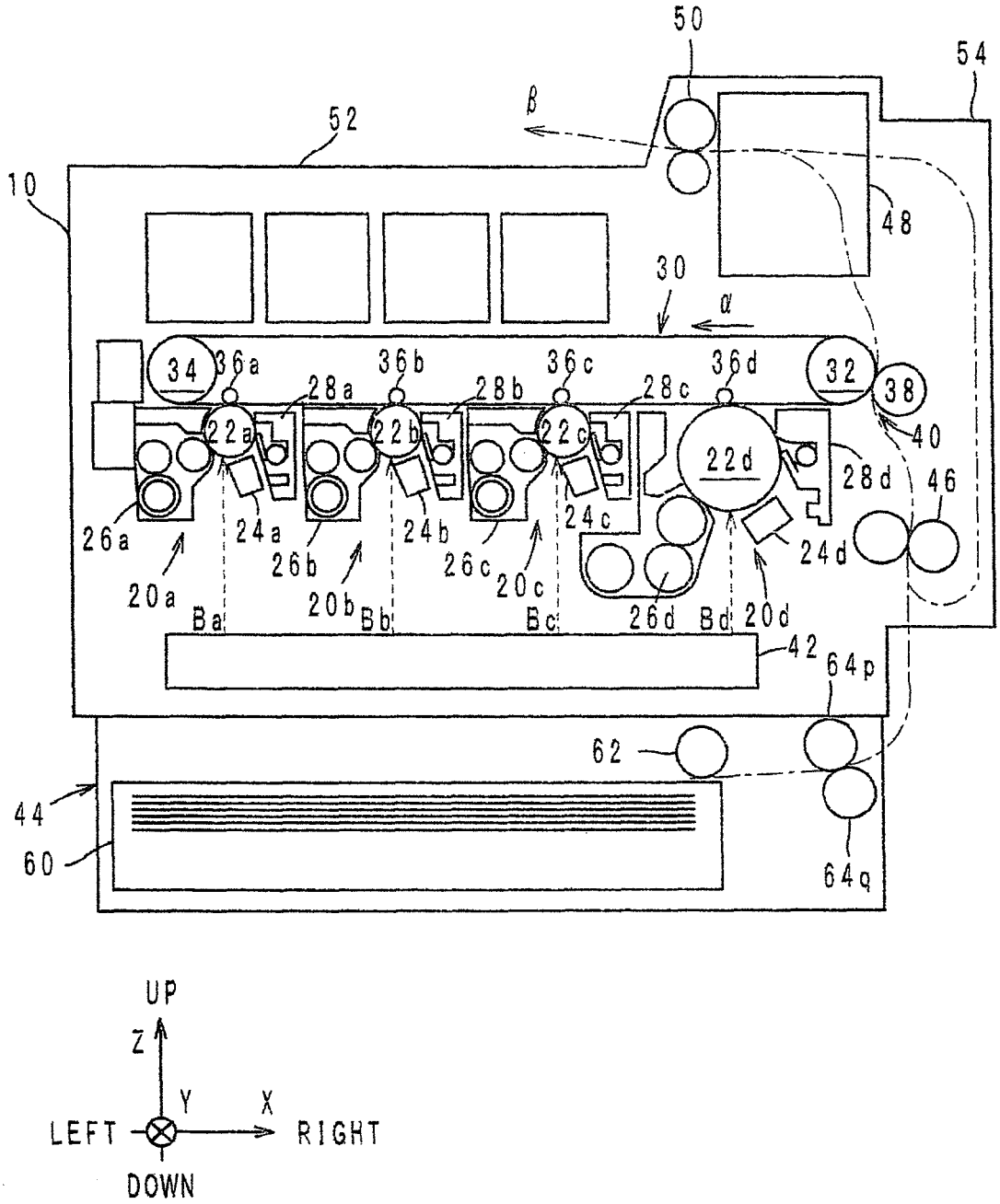
FIG. 1 is a schematic diagram illustrating the internal configuration of a general image forming apparatus.

Hereinafter, an image forming apparatus according to a first embodiment will be described with reference to the drawings. In some figures, arrows X, Y, and Z are shown. Arrows X, Y, and Z indicate the right, rear, and top sides, respectively, of the image forming apparatus. The lower-case alphabet letters a, b, c, and d suffixed to reference numerals are affixes that denote yellow (Y), magenta (M), cyan (C), and black (Bk). For example, a photoreceptor drum 22*a* is intended to mean a photoreceptor drum 22 for yellow.

General Configuration of Image Forming Apparatus

First, the image forming apparatus will be described with reference to FIG. 1. In FIG. 1, the image forming apparatus is, for example, an electrographic multifunction peripheral (MFP), color printer, copier, duplicator, or the like. For example, the image forming apparatus forms a full-color image using a tandem system, and prints the image on a recording medium such as a sheet of paper. To this end, the image forming apparatus generally includes processing units 20*a* to 20*d*, an optical laser scanning system 42, an intermediate transfer belt 30, a secondary transfer roller 38, and a fusing unit 48, all of which are provided in a main unit 10. The processing units 20*a* to 20*d*, the intermediate transfer belt 30, the secondary transfer roller 38, and the fusing unit 48 constitute a print unit 11.

The processing units 20*a* to 20*d* are arranged side-by-side from left to right in the image forming apparatus, and include photoreceptor drums 22*a* to 22*d*, which are typical examples of image supports. The photoreceptor drums 22*a* to 22*d* extend in the depth direction of the image forming apparatus, and rotate by means of drive forces from unillustrated motors. Moreover, provided around the photoreceptor drums 22*a* to 22*d* are, from upstream to downstream in their rotational directions, charging units 24*a* to 24*d*, developing units 26*a* to 26*d*, cleaning units 28*a* to 28*d*, etc.

The optical laser scanning system 42 is provided below the processing units 20*a* to 20*d*, and receives image data for the colors Y, M, C, and K from, for example, a personal computer. The optical laser scanning system 42 emits optical beams Ba to Bd, which are modulated with the received image data, to the photoreceptor drums 22*a* to 22*d*.

The intermediate transfer belt 30 is put on a roller 32, a tension roller 34, etc., and is rotationally driven in a counterclockwise loop, as indicated by arrow α, when viewed from the front side of the image forming apparatus. Moreover, primary transfer rollers 36*a* to 36*d* are provided so as to be opposed to the photoreceptor drums 22*a* to 22*d* with respect to the intermediate transfer belt 30. In addition, a secondary transfer roller 38 is disposed so as to be opposed to the roller 32 with respect to the intermediate transfer belt 30 and tightly contact the intermediate transfer belt 30. The secondary transfer roller 38 and the intermediate transfer belt 30 are typical examples of transfer units, and create a secondary transfer area 40.

A supply device 44 including at least one tray cassette is provided below the main unit 10. The supply device 44 takes up one-by-one sheets of paper placed in a cassette 60, by means of a pickup roller 62, a supply roller 64*p*, and a separation roller 64*q* provided in the device 44, and forwards them to a feeding path indicated by long dashed short dashed arrow β (referred to below as a feeding path β). Note that the configuration and the operation of the supply device 44 will be described in detail later, and therefore only a brief description will be given here.

Provided in the feeding path β are, from upstream to downstream, a timing roller pair 46, the secondary transfer area 40, the fusing unit 48, an ejection/reverse roller 50, and an output tray 52.

Furthermore, a double-sided feed unit 54 for duplex printing is provided at the right of the main unit 10.

General Operation of Print Unit in Image Forming Apparatus

Next, the general operation of the print unit 11 in the image forming apparatus will be described. In the print unit 11, the charging units 24*a* to 24*d* charge the circumferential surfaces of the rotating photoreceptor drums 22*a* to 22*d*. The optical laser scanning system 42 irradiates the charged circumferential surfaces of the photoreceptor drums 22*a* to 22*d* with optical beams Ba to Bd (i.e., exposure), thereby forming electrostatic latent images of the colors Y, M, C, and K. The developing units 26*a* to 26*d* supply toner to the photoreceptor drums 22*a* to 22*d* with the electrostatic latent images supported thereon (i.e., development), thereby forming toner images of the colors Y, M, C, and K. Due to voltage being applied to the primary transfer rollers 36*a* to 36*d*, the toner images on the photoreceptor drums 22*a* to 221 are electrostatically transferred in a sequential manner onto the same area of the intermediate transfer belt 30 (i.e., primary transfer). As a result, a full-color composite toner image is formed on the intermediate transfer belt 30. The composite toner image is fed to the secondary transfer area 40 while being supported on the intermediate transfer belt 30.

Any toner (untransferred toner) that is not subjected to primary transfer remains on the circumferential surfaces of the photoreceptor drums 22*a* to 22*d*. Such untransferred toner is scraped off by the cleaning units 28*a* to 28*d*, and collected in an unillustrated waste toner box (i.e., cleaning).

Furthermore, the electrostatic latent images remaining on the circumferential surfaces of the photoreceptor drums 22*a* to 22*d* are erased through whole image exposure by diselectrifying units (not shown) for their respective colors.

Furthermore, a sheet of paper forwarded from the supply device 44 travels in the feeding path β and contacts the timing roller pair 46 at rest without rotation. Thereafter, the timing roller pair 46 starts rotating in synchronization with transfer timing in the secondary transfer area 40, thereby feeding the sheet at temporary rest to the secondary transfer area 40.

In the secondary transfer area 40, the composite toner image on the intermediate transfer belt 30 is transferred to the sheet fed by the timing roller pair 46 (i.e., secondary transfer). The sheet subjected to secondary transfer is fed further downstream of the feeding path β by the secondary transfer roller 38 and the intermediate transfer belt 30.

The fusing unit 48 includes a fusing roller and a pressure roller. The sheet fed from the secondary transfer area 40 is introduced to a nip created by these rollers. The fusing roller heats the toner on the sheet passing through the nip, and simultaneously, the pressure roller presses the sheet (i.e., fusing process). Thereafter, the fusing roller and the pressure roller forward the sheet subjected to the fusing process, further downstream of the feeding path β.

When second-side printing is not required, the sheet subjected to the fusing process is ejected onto the output tray 52 via the ejection/reverse roller 50. On the other hand, when second-side printing is required, the sheet subjected to the fusing process is forwarded to the double-sided feed unit 54 by a switchback operation by the ejection/reverse roller 50. The double-sided feed unit 54 carries and feeds the forwarded sheet to the timing roller pair 46 for secondary transfer to the second side. Subsequent processing is the same as in the printing on the first side, and therefore any description thereof will be omitted.

Regarding Supply Device

Figure 2A:
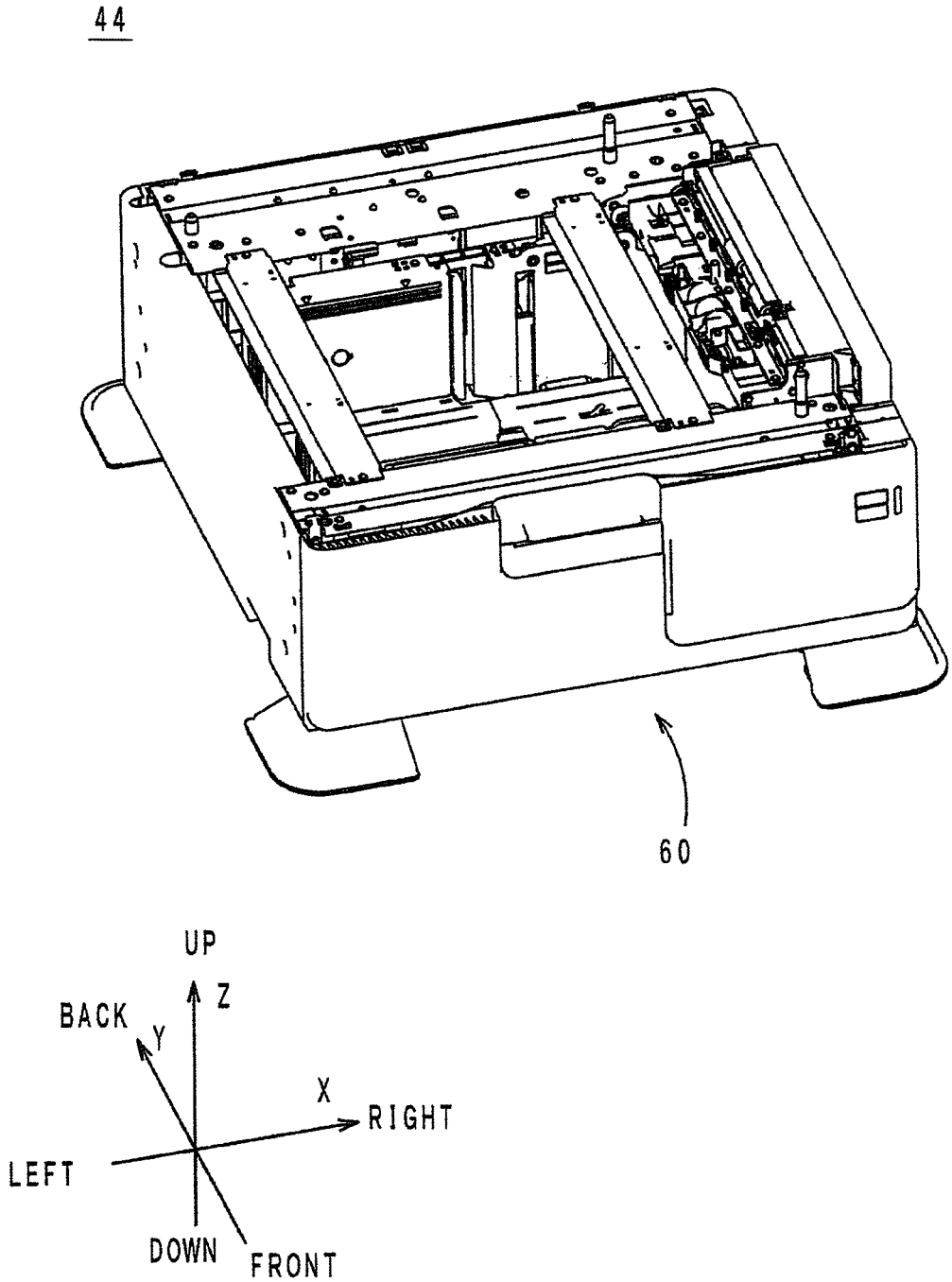
FIG. 2A is a view illustrating a supply device in which a cassette is accommodated.
Figure 2B:
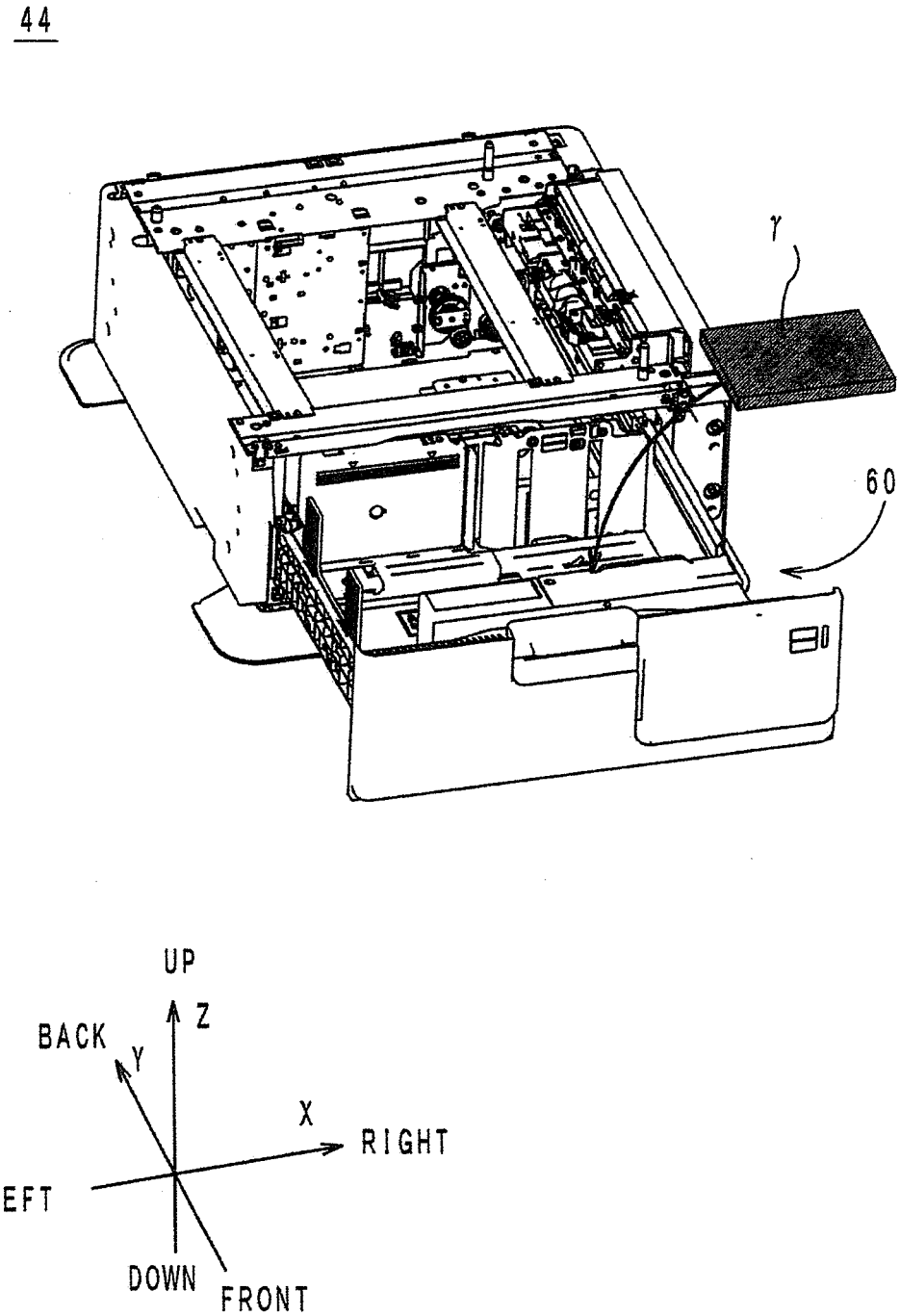
FIG. 2B is a view illustrating the supply device from which the cassette is withdrawn.

Next, the supply device 44 will be described. In the supply device 44, the cassette 60 is adapted to be slidable on guide rails (not shown), which are provided on both the right and left sides of the supply device 44, in the depth direction of the image forming apparatus and also in the opposite direction. The cassette 60 is accommodated in the supply device 44 during, for example, a printing process, as shown in FIG. 2A. At the time of loading of new sheets, the user withdraws the cassette 60 from the supply device 44, and places a bundle of sheets γ therein, as shown in FIG. 2B. Thereafter, the cassette 60 is pushed back in the supply device 44 (see FIG. 2A).

Figure 3:
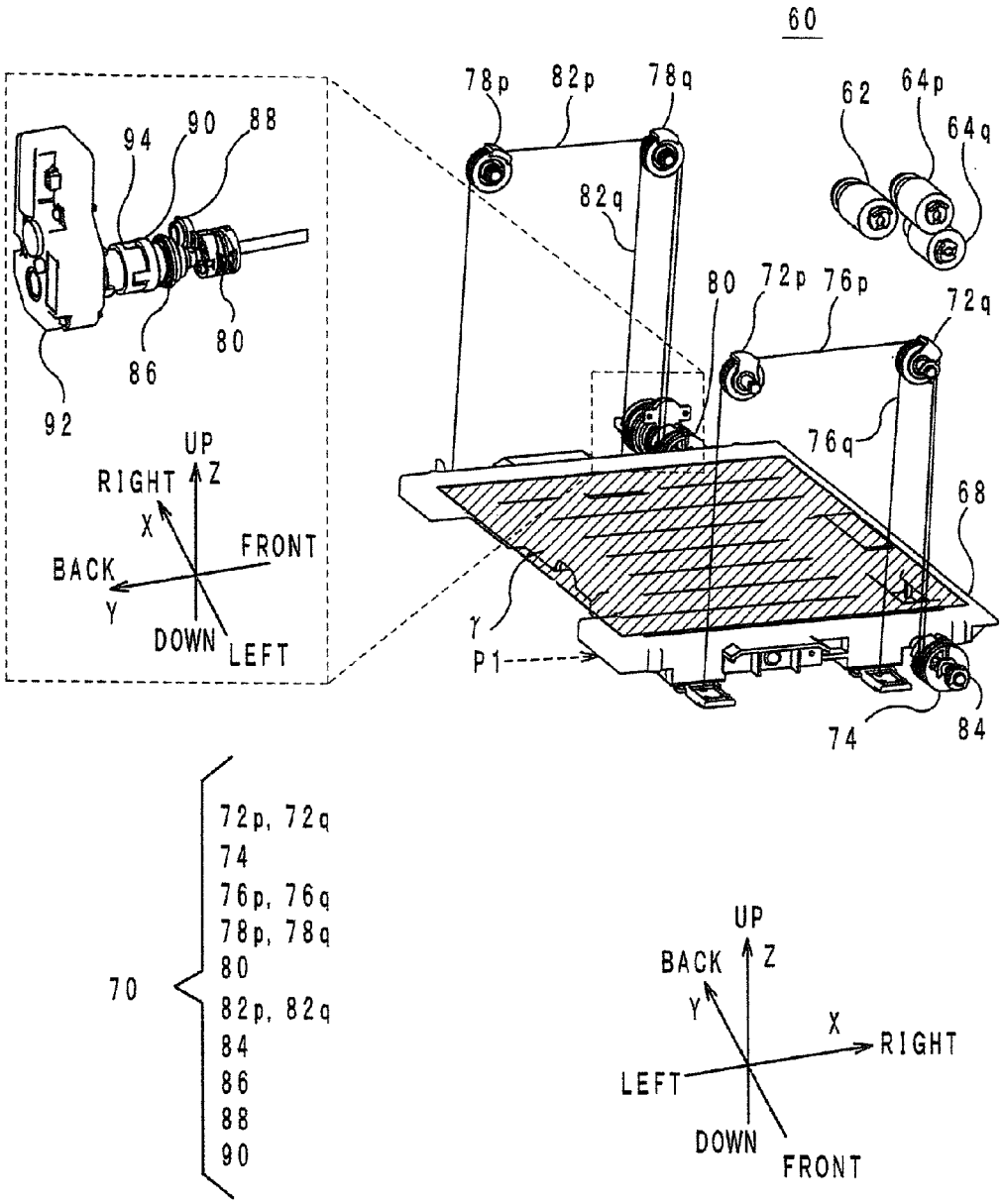
FIG. 3 is a view illustrating the internal configuration of the cassette where an elevating plate is in a bottom position.
Figure 4:
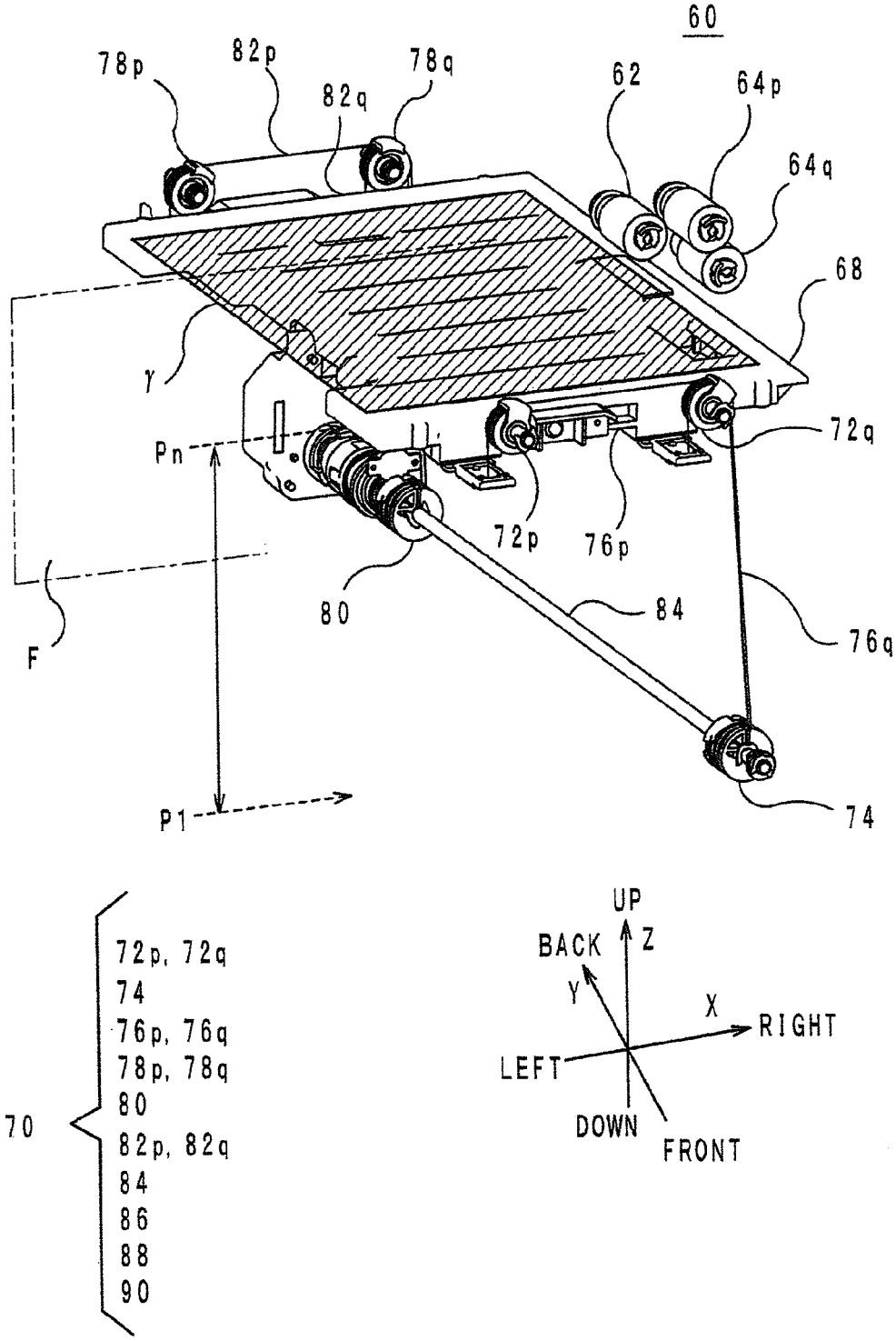
FIG. 4 is a view illustrating the internal configuration of the cassette where the elevating plate is in a top position.

FIGS. 3 and 4 illustrate the details of internal components of the cassette 60; specifically, in FIG. 3, the elevating plate is positioned at the bottom, and in FIG. 4, the elevating plate is positioned at the top. In addition to the cassette 60, and a group of rollers, including the pickup roller 62, the supply roller 64*p*, and the separation roller 64*q*, the supply device 44 includes an elevating plate 68 and a drive mechanism 70 shown in FIGS. 3 and 4.

The elevating plate 68 can have a bundle of sheets γ placed thereon, and is disposed, for example, so as to have its right edge positioned directly below the pickup roller 62. The elevating plate 68 is adapted to be able to move up and down between bottom position P1 (see FIG. 3) and top position Pn (see FIG. 4) by means of a drive force from the drive mechanism 70.

Furthermore, among the components of the drive mechanism 70, two front pulleys 72*p* and 72*q*, a front take-up pulley 74, two front wires 76*p* and 76*q*, two rear pulleys 78*p* and 78*q*, a rear take-up pulley 80, two rear wires 82*p* and 82*q*, a drive shaft 84, an idle gear 86, a damper 88, and a shaft joint 90 are attached to the cassette 60.

The pulleys 72*p* and 72*q* are provided at the internal upper front of the cassette 60; specifically, inside the cassette 60, the pulley 72*p* is positioned at the left, and the pulley 72*q* is positioned at the right. The wire 76*p* is fixed at one end to the left front of the elevating plate 68 and at the other end to the take-up pulley 74. The wire 76*p* extends between the pulleys 72*p* and 72*q* to be hung thereon and further extends downward to be fixed at both ends. The wire 76*q* is fixed at one end to the right front of the elevating plate 68 and at the other end to the take-up pulley 74. The wire 76*q* is hung on the pulley 72*q*, and extends downward to be fixed at both ends. The take-up pulley 74 is positioned in the cassette 60 at the right front side.

Here, for convenience of explanation, the elevating plate 68 is assumed to have a front-back symmetrical shape with respect to plane F parallel to ZX-plane (referred to below as transverse central plane F), as shown in FIG. 4. With respect to transverse central plane F, the pulleys 78*p* and 78*q* are arranged so as to be substantially symmetrical with the pulleys 72*p* and 72*q*, the take-up pulley 80 is arranged so as to be substantially symmetrical with the take-up pulley 74, and the wires 82*p* and 82*q* are arranged so as to be substantially symmetrical with the wires 76*p* and 76*q*.

Furthermore, the drive shaft 84 has the take-up pulley 74 fixed at one end (front-side end) and the take-up pulley 80 fixed near the other end (rear-side end). The drive shaft 84 is axially aligned with the rotation center of both of the take-up pulleys 74 and 80.

Figure 5:
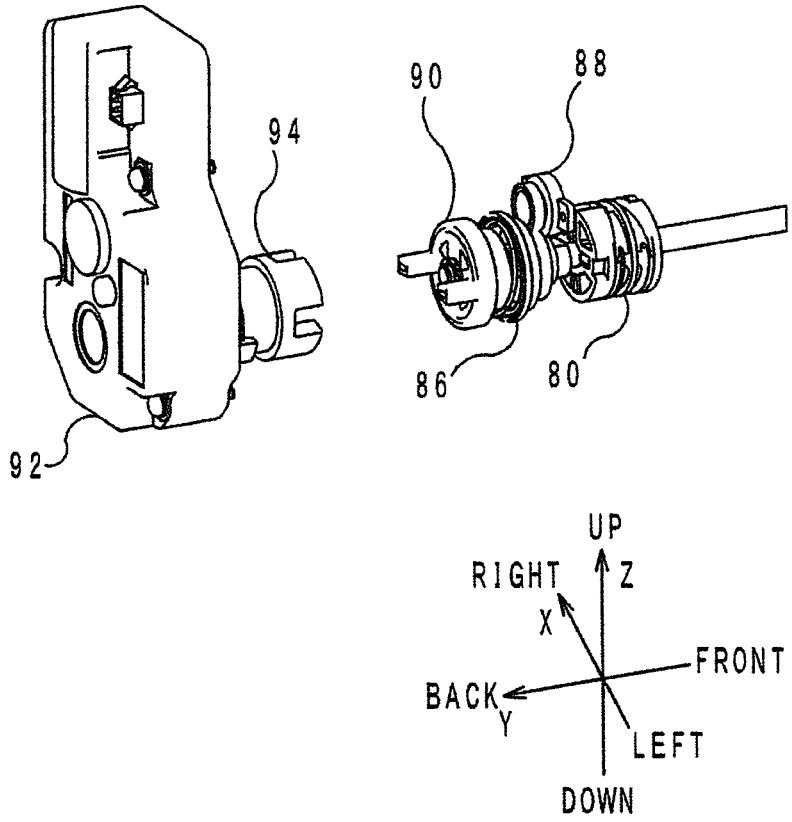
FIG. 5 is a view illustrating in enlargement a rear-side end of a drive shaft and its surrounding parts.

The rear-side end of the drive shaft 84 and its surrounding parts are illustrated in enlargement at the left in FIG. 3 and also in FIG. 5. In FIGS. 3 and 5, the rear-side end of the drive shaft 84 is connected to the shaft joint 90. Moreover, the drive shaft 84 has the idle gear 86 provided directly below the rear edge of the elevating plate 68 and coupled to the damper 88.

Furthermore, among the components of the drive mechanism 70, a motor 92 is fixed to the supply device 44. In the present embodiment, the motor 92 is of a type that rotates at a constant rotational speed regardless of torque. The motor 92 has a motor joint 94 attached at the tip of its rotating shaft. The joint 90 has two linear protrusions, and the joint 94 has two grooves to be engaged with the two protrusions. When the joints 90 are 94 are coupled, the drive force of the motor 92 is transmitted to the take-up pulleys 74 and 80 via the drive shaft 84.

Regarding Remaining Quantity Detecting Unit

Figure 6:
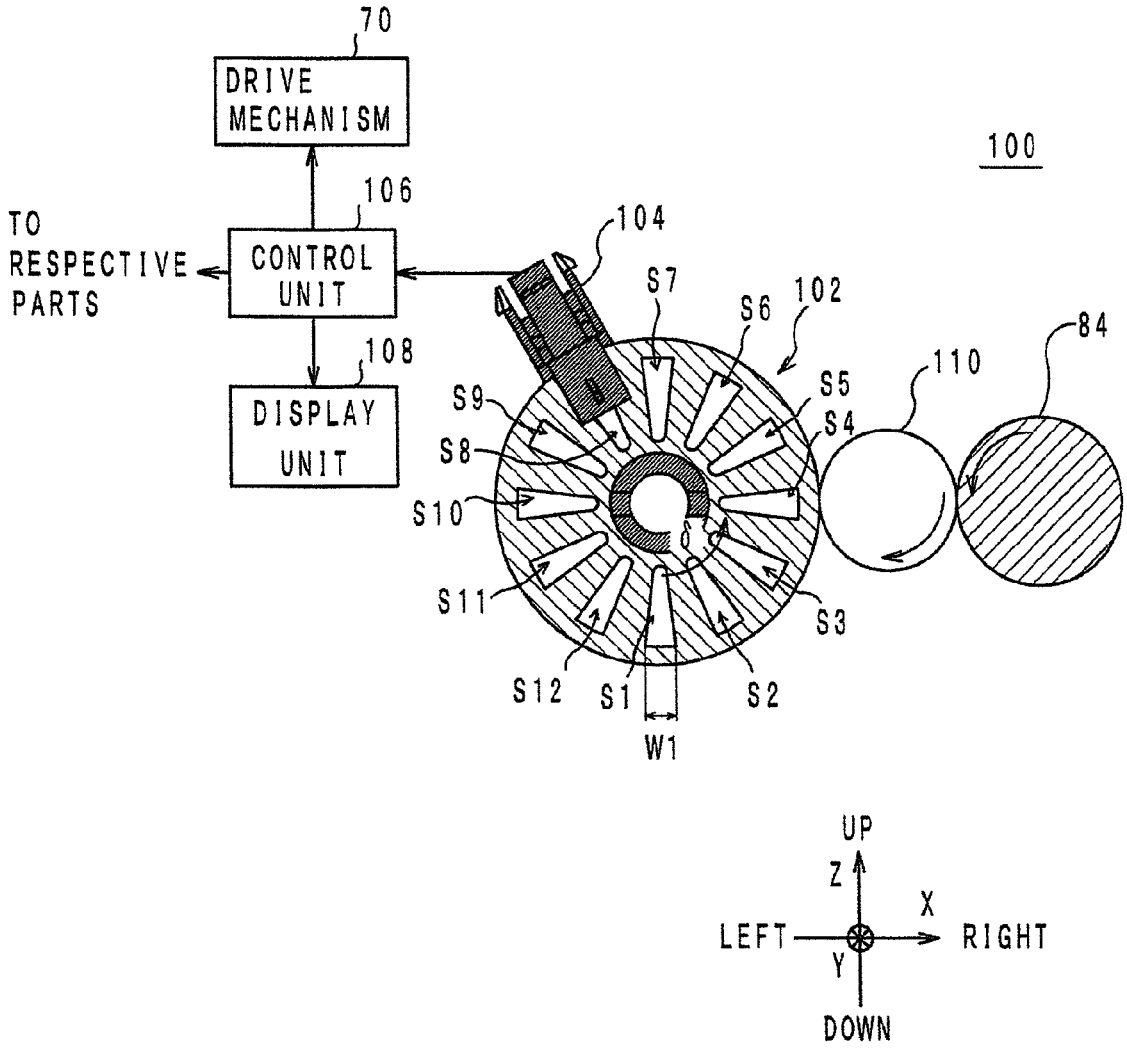
FIG. 6 is a schematic diagram illustrating the configuration of a remaining sheet quantity detecting unit included in an image forming apparatus according to a first embodiment.

The image forming apparatus further includes a remaining quantity detecting unit 100 as shown in FIG. 6. The remaining quantity detecting unit 100 includes a slit plate 102, a sensor unit 104, and a control unit 106. The slit plate 102 and the sensor unit 104 are provided in the supply device 44, and the control unit 106 and a display unit 108 are generally provided in the main unit 10.

In the example shown in FIG. 6, the slit plate 102 has a disk shape, and is coupled to the drive shaft 84 via a gear 110. The slit plate 102 rotates once for every m rotations (where m is a natural number of 1 or more) of the drive shaft 84, and can move in an amount proportional to the amount of movement of the elevating plate 68. Moreover, the slit plate 102 is adapted to rotate up to once while the elevating plate 68 moves from the bottom position to the top position ("from position P1 to position Pn" to be described later).

The slit plate 102 has a plurality of slits S1 to Sn radially provided therein. Here, n is a natural number of 2 or more, which is selected in accordance with the accuracy in detecting the position of the elevating plate 68. For high detection accuracy, n is set high. FIG. 6 shows the case where n=12.

Slits S1 to Sn have different widths W1 to Wn in rotational direction δ, which have unique values. Table 1 below shows examples of the widths W of the slits where n=12.

TABLE 1

| Slit S | Slit width W [mm] | Elevating plate position |
|---|---|---|
| S1 | 3.0 | P1 |
| S2 | 2.8 | P2 |
| S3 | 2.6 | P3 |
| S4 | 2.4 | P4 |
| S5 | 2.2 | P5 |
| S6 | 2.0 | P6 |
| S7 | 1.8 | P7 |
| S8 | 1.6 | P8 |
| S9 | 1.4 | P9 |
| S10 | 1.2 | P10 |
| S11 | 1.0 | P11 |
| S12 | 0.8 | P12 |

Figure 7:
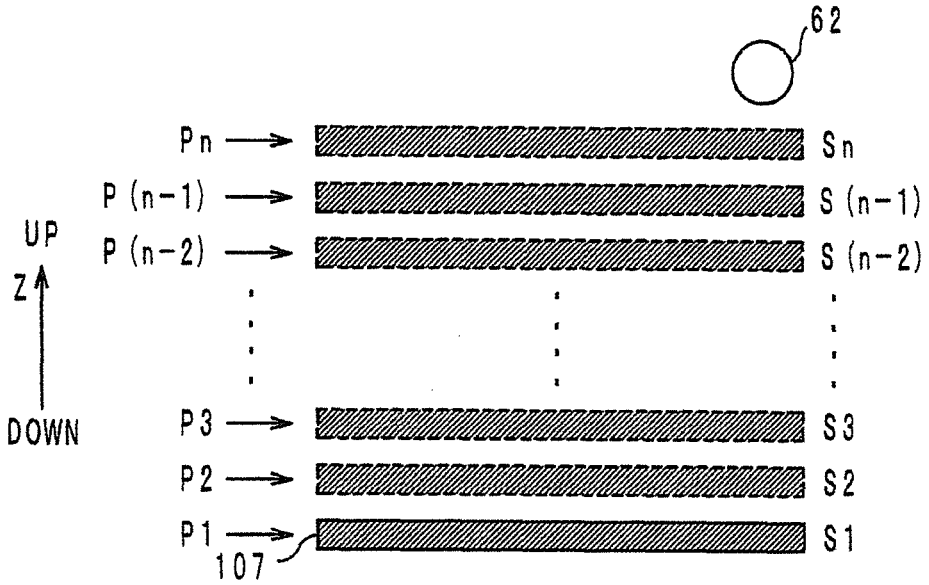
FIG. 7 is a diagram illustrating the correspondence between a plurality of slits shown in FIG. 6 and an elevating plate in the vertical direction.

The positions of slits S1 to Sn indicate different vertical positions P1 to Pn of the elevating plate 68, as shown in FIG. 7. The slits S are provided in the slit plate 102 such that elevating plate positions P1 to Pn to be detected are arranged approximately at equal intervals. Moreover, in accordance with detection by an unillustrated limit sensor, the top of the bundle of sheets γ placed on the elevating plate 68 is set in contact with the bottom of the pickup roller 62, so that the distances from the bottom of the pickup roller 62 to vertical positions P1 to Pn correspond to the thickness of the bundle of sheets γ on the elevating plate 68, and vertical positions P1 to Pn indicate remaining sheet quantities. In particular, vertical position Pn indicates that only a small quantity of sheets remains. Table 1 also shows the correspondence between slit widths W1 to Wn and vertical positions P1 to Pn. The control unit 106 has stored in its non-volatile memory (not shown) at least one table that shows the correspondence between slit widths W1 to Wn and vertical positions P1 to Pn as shown in Table 1.

The sensor unit 104 has a luminous element and a light-sensitive element, and is provided near the slit plate 102. Specifically, the luminous element is, for example, a light-emitting diode or laser diode disposed so as to emit light perpendicular to rotational direction 8 from the front side (or the rear side) of the slit plate 102. The light-sensitive element is, for example, a photodiode or phototransistor disposed so as to be opposed to the luminous element with respect to the slit plate 102. The light-sensitive element outputs to the control unit 106 a detection signal that indicates whether light emitted by the luminous element is in a transmitted state or in a blocked state.

The control unit 106 includes, for example, a CPU or main memory, and controls components of the apparatus to perform various processing operations. Typical examples of such operations include the operation of lifting up the elevating plate 68, the operation of supplying a sheet from the supply device 44 to the main unit 10, and the printing operation. In addition, the control unit 106 detects a remaining sheet quantity on the basis of the result of detection by the sensor unit 104.

Furthermore, the remaining quantity detecting unit 100 further includes the display unit 108 as a preferable feature for notifying the user of the remaining sheet quantity. The display unit 108 is provided at the top of the main unit 10 to display various types of information including the remaining sheet quantity.

Figure 8:
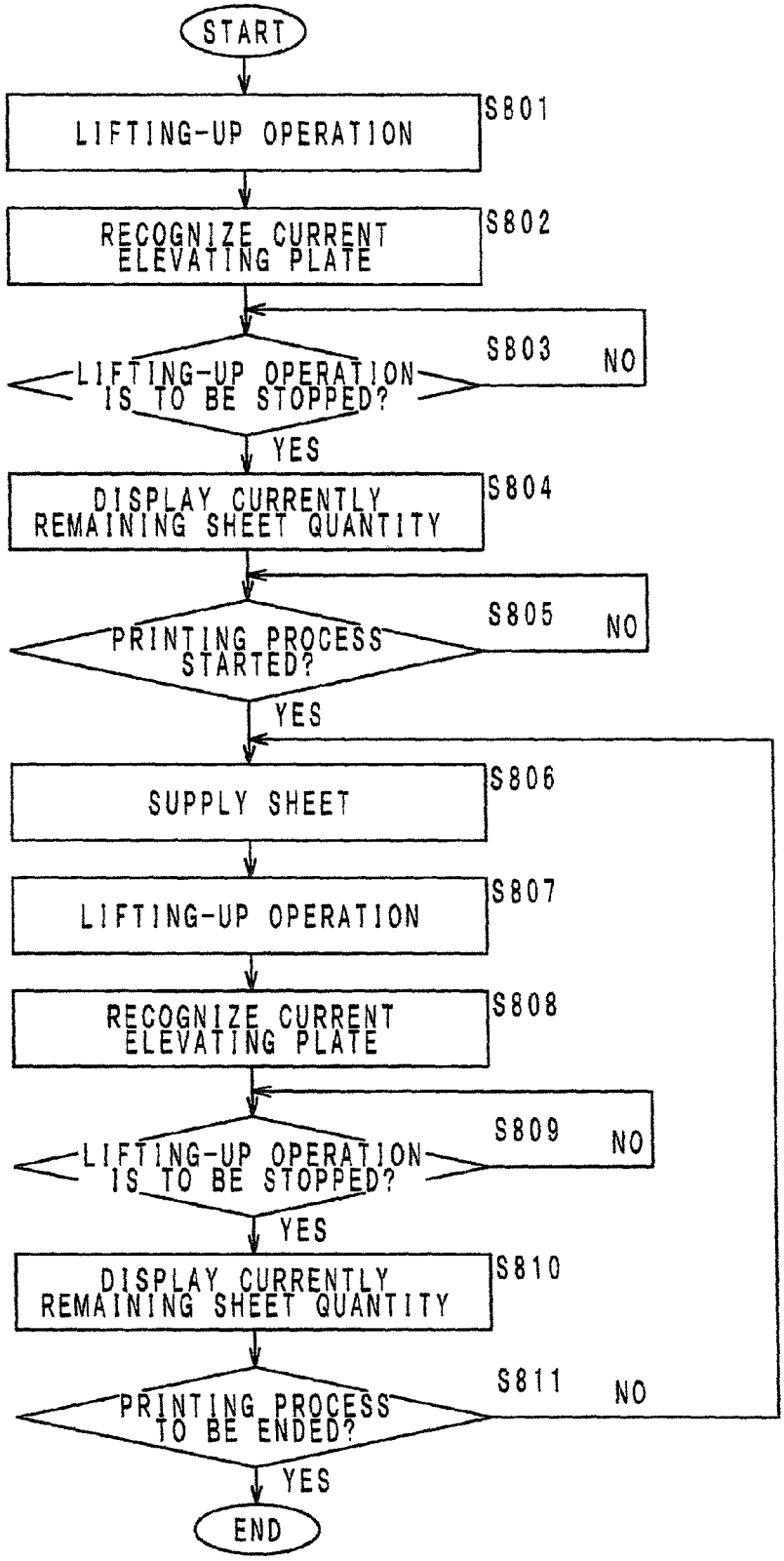
FIG. 8 is a flowchart showing process steps by the remaining sheet quantity detecting unit shown in FIG. 6.

Hereinafter, the process of detecting the remaining sheet quantity will be described with reference to FIG. 8. Once the user withdraws the cassette 60 for loading of new sheets (see FIG. 2B), the joints 90 and 94 are decoupled, and therefore, in the case where the elevating plate 68 is not in bottom position P1, it descends under its own weight and the weight of the bundle of sheets γ placed thereon, so that the wires 76*p*, 76*q*, 82*p*, and 82*q* are released. At this time, the damper 88 prevents the elevating plate 68 from abruptly falling.

After the sheet loading, once the user pushes the cassette 60 back in the supply device 44 (see FIG. 2A), the joints 90 and 94 are coupled again. In response to this, the control unit 106 starts the operation of lifting up the elevating plate 68. In the lifting-up operation, the motor 92 starts rotating in response to a drive signal from the control unit 106. The drive force is transmitted to the take-up pulleys 74 and 80 via the drive shaft 84. The take-up pulley 74 rewinds the wires 76*p* and 76*q*, and the take-up pulley 80 rewinds the wires 82*p* and 82*q*. As a result, the elevating plate 68 with the bundle of sheets γ placed thereon starts ascending through the lifting-up operation (S801).

The slit plate 102 also starts rotating by means of the drive force of the motor 92. Here, as mentioned above, the motor 92 rotates approximately at a constant rotational speed regardless of torque, and therefore the rotational speed of the slit plate 102 is approximately constant regardless of the weight of the bundle of sheets γ on the elevating plate 68. In the sensor unit 104, the light-sensitive element continuously transmits to the control unit 106 a detection signal which indicates that light emitted by the luminous element is transmitted (or blocked) by the slit plate 102. The control unit 106 multiplies the duration of the transmitted state (or blocked state) indicated by a received detection signal by the number of revolutions of the slit plate 102, thereby calculating and holding the width of the current slit that has just passed the sensor unit 104. From the aforementioned table (see Table 1), the control unit 106 acquires a vertical position of the elevating plate 68 that corresponds to the slit width, and thereby identifies the current vertical position (i.e., the current position) of the elevating plate 68 (S802).

During the lifting-up operation, once the top of the bundle of sheets γ contacts the pickup roller 62, the unillustrated limit sensor detects the contact and transmits a signal to stop the lifting-up operation (referred to below as a first stop signal) to the control unit 106.

Following S802, the control unit 106 determines whether the first stop signal has been received or not (S803). When the determination is NO, the control unit 106 performs S802 again. On the other hand, when the determination is YES, the control unit 106 provides a stop signal (referred to below as a second stop signal) to the motor 92, memorizes the current position identified in S802 as a currently remaining sheet quantity, and causes the display unit 108 to display that currently remaining sheet quantity (S804). Thus, the user can be informed of the quantity of sheets remaining in the cassette 60.

The control unit 106 waits for a printing process to start. Once the printing process starts (S805), the control unit 106 controls components of the main unit 10, and further, drives the pickup roller 62, etc. The supply device 44 sequentially takes up sheets from the top of the bundle of sheets γ on the elevating plate 68, and supply them to the main unit 10 (S806). As described in the "General Operation of Image Forming Apparatus" section, full-color toner images are printed on the sheets.

During the printing process, the quantity of sheets on the elevating plate 68 decreases, and therefore the control unit 106 controls the lifting-up operation as in S801 (S807). During that time, in response to a detection signal from the sensor unit 104, the control unit 106 updates the current position of the elevating plate 68 upon each detection of a transition from the start of a transmitted state (or blocked state) to a subsequent blocked state (or transmitted state) in the same process as in S802 (S808). Note that when the amount of movement of the elevating plate 68 in one lifting-up operation is less than an amount of movement for detecting one slit width, no slit width can be detected so that identification of any slit S is not possible, but it is possible to recognize the number of slits that are present between the slit S identified in S802 and the N'th slit therefrom, so that the position of the elevating plate 68 can be derived. Note that in the case where slit widths are set in increments so small that slit width detection is possible in one lifting-up operation, the current position of the elevating plate 68 may be identified and updated in S808 in the same manner as in S802, rather than in the manner as described above in conjunction with S808.

Thereafter, the control unit 106 performs the same processing as in S803 and S804, thereby updating the currently remaining sheet quantity (S809 and S810). The processing in S807 to S810 is repeated until the end of the printing process is determined in S811.

Effects of First Embodiment

As described above, in the present embodiment, slits S1 to Sn of different widths are provided in the slit plate 102 that rotates in synchronization with the drive shaft 84. In addition, the slit plate 102 is adapted to rotate up to once while the elevating plate 68 moves from the bottom position P1 to the top position Pn. Here, Slits S1 to Sn correspond to vertical positions P1 to Pn of the elevating plate 68. The control unit 106 derives the width of the current slit that has just passed the sensor unit 104, thereby identifying the current vertical position of the elevating plate 68. In other words, the control unit 106 identifies a currently remaining sheet quantity. The currently remaining sheet quantity is displayed on the display unit 108. In this manner, in the present embodiment, a single sensor unit 104 can accurately detect the quantity of remaining sheets (of recording medium) at several levels, the number of which correspond to the number of slits.

Furthermore, if all slits are equal in width, a relative position of the elevating plate can be calculated by obtaining the amount of movement of a slit, but the absolute position of the elevating plate cannot be identified. Accordingly, it is necessary to provide another sensor for detecting the elevating plate in a reference position, or it is necessary to drive the motor for a significant period of time to temporary lower the elevating plate to the lowest position and then raise the elevating plate after resetting position information, in order to identify the position of the elevating plate.

On the other hand, the remaining quantity detecting unit 100 according to the present embodiment uses the slit plate 102, which is adapted such that the slits S differ in width from one another, and therefore it is possible to achieve the effect of identifying the absolute position of the elevating plate 68 immediately upon detection of one slit S.

Supplementary 1

Note that the slit plate of the first embodiment is has a disk shape, and rotates with rotation of the drive shaft 84. However, this is not restrictive, and a rectangular slit plate may be moved in a reciprocating manner by the drive shaft 84 rotating in a rack-and-pinion system. In such a case, a plurality of slits are arranged in the direction of reciprocation, and differ in width.

Supplementary 2

Furthermore, in the first embodiment, at least one from among slits S1 to Sp is required to pass the sensor unit 104 during the first lifting-up operation. Moreover, the duration of the lifting-up is shortest when the user loads sheets of paper on the elevating plate 68 to the maximum limit (at the time of so-called full loading) or when the user removes the cassette 60 and put it back. Accordingly, the slit plate 102 is preferably formed such that at least one from among slits S1 to Sp passes the sensor unit 104 in both of the above circumstances.

Second Embodiment

Next, an image forming apparatus according to a second embodiment will be described. The second embodiment differs from the first embodiment only in that the remaining quantity detecting unit 100 is replaced by a remaining quantity detecting unit 200. Accordingly, FIGS. 1 to 5 are referenced in the second embodiment. Moreover, in the second embodiment, components that correspond to those in the first embodiment are denoted by the same reference numbers, and any descriptions thereof will be omitted.

Regarding Remaining Quantity Detecting Unit

Figure 9:
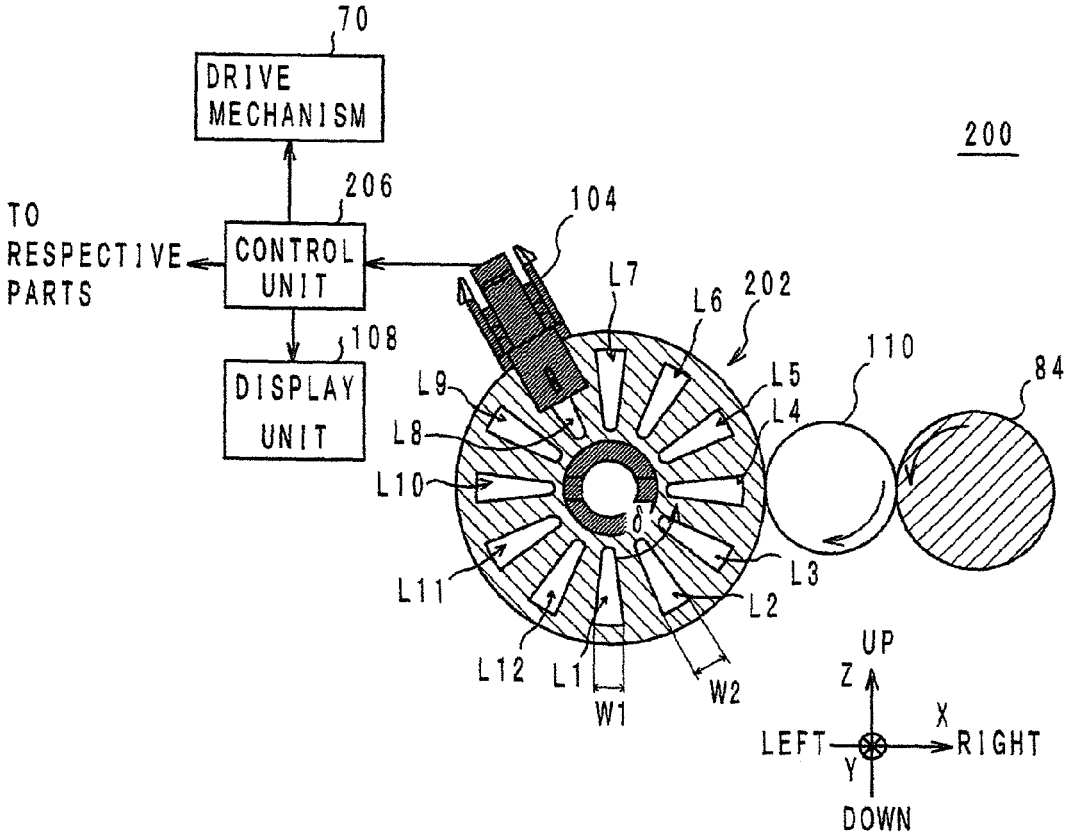
FIG. 9 is a schematic diagram illustrating the configuration of a remaining sheet quantity detecting unit included in an image forming apparatus according to a second embodiment.

In FIG. 9, the remaining quantity detecting unit 200 differs from the remaining quantity detecting unit 100 (see FIG. 6) only in that the slit plate 102 and the control unit 106 are replaced by a slit plate 202 and a control unit 206. Accordingly, in FIG. 9, components that correspond to those in FIG. 6 are denoted by the same reference numbers, and any descriptions thereof will be omitted.

The slit plate 202 differs from the slit plate 102 in that a plurality of slits L1 to Lp are radially provided therein. Here, p is a natural number of at least 2 or more, which is appropriately selected in accordance with the accuracy in detecting the position of the elevating plate 68. FIG. 9 shows the case where p=12.

Slits L1 to Lp have widths W1 to Wp in rotational direction δ. In FIG. 9, for convenience sake, slits L1 and L2 are shown as having widths W1 and W2. In the present embodiment, any two adjacent slits (neighboring slits) in rotational direction 8 have different width ratios (referred to below as neighboring-slit ratios) Wq/W(q−1). Here, q is a natural number of from 2 to p. Table 2 below shows specific examples of values for widths W1 to Wp and neighboring-slit ratios Wq/W(q−1) of the slits where p=12.

TABLE 2

| Slit L | Slit width W [mm] | Ratio Wq/W(q − 1) | Elevating plate position |
|---|---|---|---|
| L1 | 1.0 | — | P1 |
| L2 | 3.0 | 3.0 | P2 |
| L3 | 1.0 | 0.3 | P3 |
| L4 | 1.4 | 1.4 | P4 |
| L5 | 2.2 | 1.6 | P5 |
| L6 | 2.6 | 1.2 | P6 |
| L7 | 2.8 | 1.1 | P7 |
| L8 | 2.6 | 0.9 | P8 |
| L9 | 1.8 | 0.7 | P9 |
| L10 | 1.0 | 0.6 | P10 |
| L11 | 0.8 | 0.8 | P11 |
| L12 | 1.0 | 1.3 | P12 |

Figure 10:
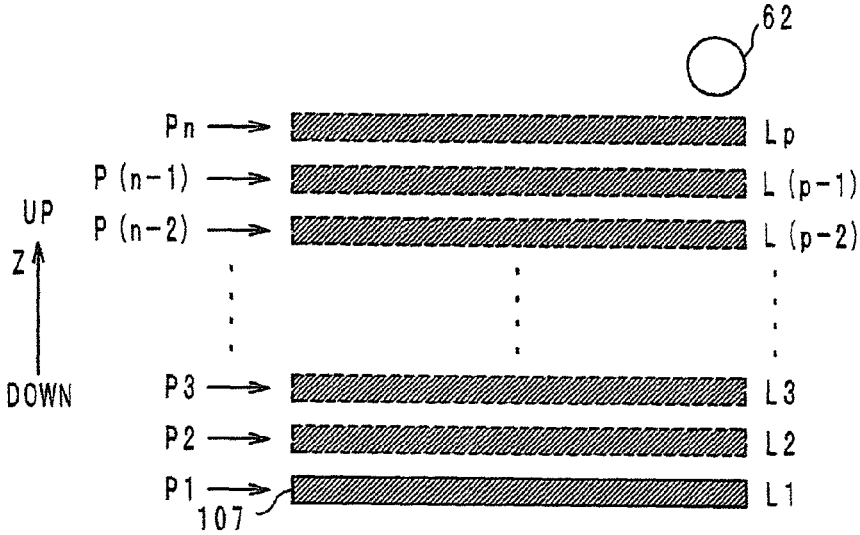
FIG. 10 is a diagram illustrating the correspondence between a plurality of slits shown in FIG. 9 and an elevating plate in the vertical direction.

Slits L1 to Lp and also neighboring-slit ratios Wq/W(q−1) indicate vertical positions P1 to Pn of the elevating plate 68, as shown in FIG. 10. Moreover, as described above, vertical positions P1 to Pn indicate remaining sheet quantities. Table 2 also shows the correspondence between slits L1 to Ln or neighboring-slit ratios Wq/W(q−1) and vertical positions P1 to Pn. The control unit 206 has stored in its non-volatile memory (not shown) at least one table that shows the correspondence between neighboring-slit ratios Wq/W(q−1) and vertical positions P1 to Pn.

Figure 11:
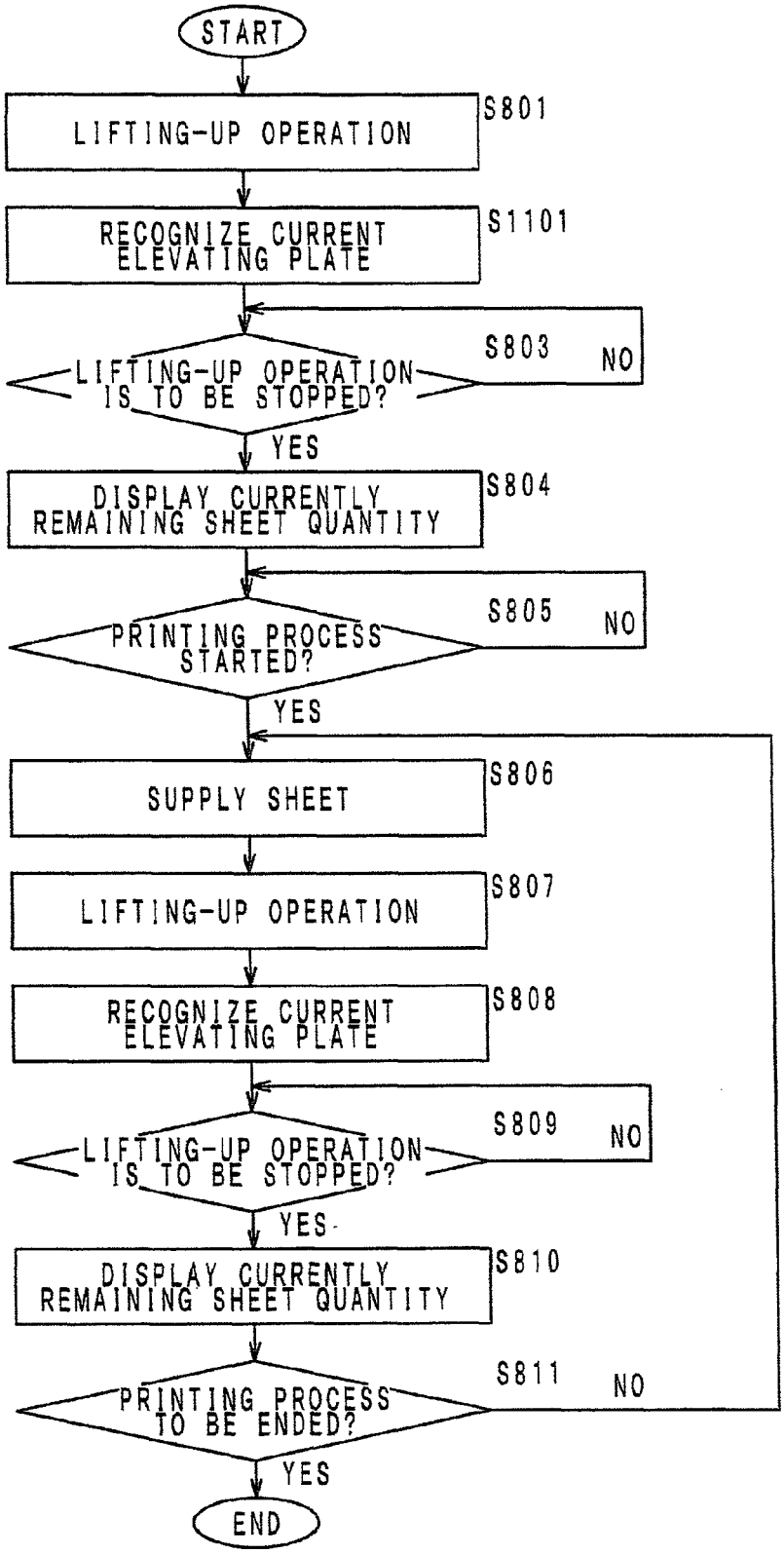
FIG. 11 is a flowchart showing process steps by the remaining sheet quantity detecting unit shown in FIG. 9.

The control unit 206 differs from the control unit 106 in that it performs detection processes for different remaining sheet quantities. Hereinafter, the process of detecting the remaining sheet quantity by the control unit 206 will be described with reference to FIG. 11. FIG. 11 differs from FIG. 8 only in that step S802 is replaced by step S1101. Accordingly, in FIG. 11, steps that correspond to those in FIG. 8 are denoted by the same step numbers, and any descriptions thereof will be omitted.

During the lifting-up of the elevating plate 68, if the motor 92 rotates approximately at a constant rotational speed regardless of torque, then the rotational speed of the slit plate 202 is approximately constant. The sensor unit 104 continuously transmits a detection signal as described in the first embodiment to the control unit 206. The control unit 206 multiplies the duration of the transmitted state (or blocked state) indicated by a received detection signal by the number of revolutions of the slit plate 202, thereby calculating and holding the width Wq of the current slit that has just passed the sensor unit 104. Moreover, the control unit 206 holds the width W(q−1) of the last slit that previously passed the sensor unit 104. On the basis of these slit widths, the control unit 206 calculates a neighboring-slit ratio Wq/W(q−1), and acquires a vertical position of the elevating plate 68 that corresponds to that ratio, from the table (see Table 2), thereby identifying the current vertical position (i.e., the current position) of the elevating plate 68 (S1101).

Following S1101, the determination of S803 is made, and if the result is YES, the vertical position Pq identified in S1101 is memorized as the currently remaining sheet quantity, and is also displayed on the display unit 108 (S804).

Furthermore, after the start of a printing process, the processing in S805 to S811 is performed, as in the first embodiment.

Effects of Second Embodiment

As described above, in the present embodiment, the slit plate 202 has slits L1 to Lp provided therein, such that the ratio of widths of any two adjacent slits in rotational direction δ takes a unique value. Slits L1 to Lp indicate vertical positions P1 to Pn of the elevating plate 68 (i.e., remaining sheet quantities). From a neighboring-slit ratio Wq/W(q−1) obtained on the basis of a detection signal from the sensor unit 104, including the luminous element and the light-sensitive element, the control unit 206 identifies a remaining sheet quantity, and causes the display unit 108 to display that remaining sheet quantity. In this manner, in the present embodiment, a single sensor unit 104 can accurately detect the quantity of remaining sheets (of recording medium) at several levels, the number of which correspond to the number of slits.

Furthermore, as described above, if all slits are equal in width, a relative position of the elevating plate can be calculated by obtaining the amount of movement of a slit, but the absolute position of the elevating plate cannot be identified. On the other hand, the remaining quantity detecting unit 200 according to the present embodiment uses the slit plate 202, which is adapted such that the neighboring-slit ratios Wq/W(q−1) take different values, and therefore it is possible to achieve the effect of identifying the absolute position of the elevating plate 68 immediately upon determination of a slit ratio Wq/W(q−1).

Supplementary 1

In the first embodiment, the motor 92 is substantially limited to a type that rotates approximately at a constant rotational speed regardless of torque. The reason for this is that the slit plate 102 is required to rotate at a steady speed regardless of the quantity of the bundle of sheets γ since the bundle of sheets γ placed on the elevating plate 68 during the first lifting-up operation varies in quantity.

On the other hand, in the second embodiment, the motor 92 may be of a type that rotates approximately at a constant rotational speed regardless of torque, or may be of a type whose rotational speed changes in accordance with torque even when the control unit 206 controls the motor to rotate at a constant rotational speed. The reason for this is that, when the rotational speed of the motor 92 changes in accordance with torque, the ascent speed of the elevating plate 68 varies in accordance with the quantity of the bundle of sheets γ during the first lifting-up operation. However, after the bundle of sheets γ is placed, the ascent speed of the elevating plate 68 does not change during a period from the start of the lifting-up to the contact of the top of the bundle of sheets γ with the pickup roller 62. Therefore, by determining the ratio of slit widths during that period, the remaining sheet quantity can be accurately detected. Moreover, by identifying the remaining sheet quantity at the time of the initial lifting-up, the remaining sheet quantity can be readily detected during lifting-up involved in the supply of sheets, even as the quantity of the bundle of sheets γ decreases.

Supplementary 2

Furthermore, in the second embodiment, at least two neighboring slits from among slits L1 to Lp are required to pass the sensor unit 104 during the first lifting-up operation. Moreover, the duration of the lifting-up is shortest at the time of so-called full loading or when the cassette 60 is removed and put back. Accordingly, the slit plate 202 is preferably formed such that at least two from among slits L1 to Lp pass the sensor unit 104 in both of the above circumstances.

Specifically, at the time of full loading, at least one from among slits L1 to Lp passes the sensor unit 104 before the bundle of sheets γ in the top position moves to contact the pickup roller 62.

Furthermore, when the cassette 60 is removed and put back instantly, at least two from among slits L1 to Lp pass the sensor unit 104 after the joints 90 and 94 are decoupled and before they are coupled again. More specifically, in the second embodiment, the joint 90 has two linear protrusions, and the joint 94 has two grooves to be engaged with the two protrusions. In this case, the joint 90 is turned 180° after the joints 90 and 94 are decoupled and before they are coupled again. During this period, at least two from among slits L1 to Lp pass the sensor unit 104.

Supplementary 3

In the first and second embodiments, the control unit, 106 or 206, in response to a detection signal from the sensor unit 104, updates the current position of the elevating plate 68 upon each detection of a transition from the start of a transmitted state (or blocked state) to a subsequent blocked state (or transmitted state) (S808), and displays the current position of the elevating plate 68 as the remaining sheet quantity (S810). However, the control unit, 106 or 206, can count the number of sheets supplied during a transition from the start of a transmitted state (or blocked state) to a subsequent blocked state (or transmitted state), and thereafter calculate (the number of sheets/the amount of movement of the elevating plate 68) as a sheet density, thereby identifying the remaining sheet quantity with high accuracy to the exact number of sheets.

Although the present invention has been described in connection with the preferred embodiment above, it is to be noted that various changes and modifications are possible to those who are skilled in the art. Such changes and modifications are to be understood as being within the scope of the invention.

What is claimed is:

1. An image forming apparatus comprising:

an elevating plate provided in a cassette so as to be able to ascend in a range from a bottom position to a top position with sheets of recording medium placed thereon;

a roller group at least including a pickup roller to take up and feed the top of the sheets of recording medium placed on the elevating plate during a printing process;

a print unit that forms an image on the recording medium fed by the roller group during the printing process;

a drive mechanism at least including a motor whose rotational speed is kept constant regardless of torque, the drive mechanism raising the elevating plate by means of a drive force from the motor until the top of the sheets of recording medium placed on the elevating plate contacts the pickup roller;

a slit plate having a plurality of slits of different widths provided therein, the slit plate being movable in an amount proportional to an amount of movement of the elevating plate while the elevating plate ascends from the bottom position to the top position;

a sensor unit disposed such that the slits pass between a luminous element and a light-sensitive element, the sensor unit outputting a detection signal that indicates whether light emitted by the luminous element is in a transmitted state or in a blocked state; and a control unit having memorized therein positions of the elevating plate that correspond to the widths of the slits, the control unit identifying a position of the elevating plate that corresponds to a slit width derived from a detection signal outputted by the sensor unit when the motor is driven at a constant rotational speed, thereby deriving a remaining quantity of sheets on the elevating plate.

2. The image forming apparatus according to claim 1, wherein, the drive mechanism further includes a drive shaft capable of being coupled to and decoupled from the motor, to transmit the drive force from the motor, and the slit plate is formed such that, when new sheets of recording medium are loaded on the elevating plate by removing the cassette from a main unit of the image forming apparatus and putting the cassette back in the main unit, the motor and the drive shaft are decoupled so that the elevating plate descends under its own weight, and after completion of the loading, one of the slits passes the sensor unit while the elevating plate ascends until the motor and the drive shaft are coupled again.

3. The image forming apparatus according to claim 1, wherein the slit plate is a disk with a plurality of slits provided therein, and is adapted to rotate a full turn or less while the elevating plate ascends from the bottom position to the top position.

4. The image forming apparatus according to claim 1, wherein, in accordance with a detection signal outputted by the sensor unit, the control unit updates the position of the elevating plate upon each transition from either the transmitted state or the blocked state to the other during the printing process.

5. The image forming apparatus according to claim 1, wherein the control unit derives a remaining sheet quantity during the printing process on the basis of the identified position of the elevating plate and a recording medium density that is obtained by counting and calculating the number of sheets of recording medium fed by the roller group over the amount of change in the position of the elevating plate derived from a detection signal outputted by the sensor unit.

6. An image forming apparatus comprising:

an elevating plate provided in a cassette so as to be able to ascend in a range from a bottom position to a top position with sheets of recording medium placed thereon;

a roller group at least including a pickup roller to take up and feed the top of the sheets of recording medium placed on the elevating plate during a printing process;

a print unit that forms an image on the recording medium fed by the roller group during the printing process;

a drive mechanism at least including a motor, the drive mechanism raising the elevating plate by means of a drive force from the motor until the top of the sheets of recording medium placed on the elevating plate contacts the pickup roller;

a slit plate having a plurality of slits provided therein, the slit plate being movable in an amount proportional to an amount of movement of the elevating plate while the elevating plate ascends from the bottom position to the top position, wherein the slit plate is adapted such that any two neighboring slits from among all of the slits have different width ratios;

a sensor unit disposed such that the slits pass between a luminous element and a light-sensitive element, the sensor unit outputting a detection signal that indicates whether light emitted by the luminous element is in a transmitted state or in a blocked state; and a control unit having memorized therein positions of the elevating plate that correspond to ratios of neighboring-slit widths, the control unit identifying a position of the elevating plate that corresponds to a ratio of neighboring-slit widths obtained on the basis of widths of neighboring slits derived from a detection signal outputted by the sensor unit when the motor is driven at a constant rotational speed, thereby deriving a remaining quantity of sheets on the elevating plate.

7. The image forming apparatus according to claim 6, wherein, the drive mechanism further includes a drive shaft capable of being coupled to and decoupled from the motor, to transmit the drive force from the motor, and the slit plate is formed such that, when new sheets of recording medium are loaded on the elevating plate by removing the cassette from a main unit of the image forming apparatus and putting the cassette back in the main unit, the motor and the drive shaft are decoupled so that the elevating plate descends under its own weight, and after completion of the loading, any neighboring slits from among all of the slits pass the sensor unit while the elevating plate ascends until the motor and the drive shaft are coupled again.

8. The image forming apparatus according to claim 6, wherein the slit plate is formed such that, when new sheets of recording medium are loaded on the elevating plate by removing the cassette from a main unit of the image forming apparatus and putting the cassette back in the main unit, any neighboring slits from among all of the slits pass the sensor unit while the elevating plate is raised by the drive mechanism until the top of the sheets of recording medium placed on the elevating plate contacts the pickup roller.

9. The image forming apparatus according to claim 6, wherein the slit plate is a disk with a plurality of slits provided therein, and is adapted to rotate a full turn or less while the elevating plate ascends from the bottom position to the top position.

10. The image forming apparatus according to claim 6, wherein, in accordance with a detection signal outputted by the sensor unit, the control unit updates the position of the elevating plate upon each transition from either the transmitted state or the blocked state to the other during the printing process.

11. The image forming apparatus according to claim 6, wherein the control unit derives a remaining sheet quantity during the printing process on the basis of the identified position of the elevating plate and a recording medium density that is obtained by counting and calculating the number of sheets of recording medium fed by the roller group over the amount of change in the position of the elevating plate derived from a detection signal outputted by the sensor unit.

* * * * *